United States Patent [19]

Fletcher

[11] Patent Number: 5,036,731

[45] Date of Patent: Aug. 6, 1991

[54] RAZOR SHARPENING DEVICE

[76] Inventor: Charles J. Fletcher, 7 Valley Rd., Fox Hollow Farms, Sparta, N.J. 07871

[21] Appl. No.: 596,340

[22] Filed: Oct. 12, 1990

[51] Int. Cl.[5] ..... B21K 5/12

[52] U.S. Cl. ..... 76/82; 30/35; 51/211 H; 51/214; 76/DIG. 9

[58] Field of Search ..... 30/35; 76/81, 82, DIG. 8, 76/DIG. 9; 51/211 R, 211 H, 212–214

[56] References Cited

U.S. PATENT DOCUMENTS

| | | | |
|---|---|---|---|
| 1,540,078 | 6/1925 | Long | 76/DIG. 9 |
| 1,588,322 | 6/1926 | McAdoo | 76/DIG. 9 |
| 1,594,246 | 7/1926 | Dechert | 76/82 |
| 2,094,722 | 10/1937 | Sandford | 30/35 X |
| 2,458,257 | 1/1949 | Domovan | 30/35 UX |

*Primary Examiner*—Douglas D. Watts

*Attorney, Agent, or Firm*—Pollock, Vande Sande & Priddy

[57] ABSTRACT

Apparatus for sharpening a razor blade including a sharpening member, a housing for securing the sharpening member therein and for guiding a razor blade in back-and-forth sharpening movement within the housing. The housing has a transverse slot for inserting a head of a razor blade holder therein, and a longitudinal slot in a top plate thereof for linear movement therein of the handle which carries the blade holder. The sharpening or honing member is preferably made of a plate of glass secured to the bottom wall of the housing.

9 Claims, 1 Drawing Sheet

FIG. 1
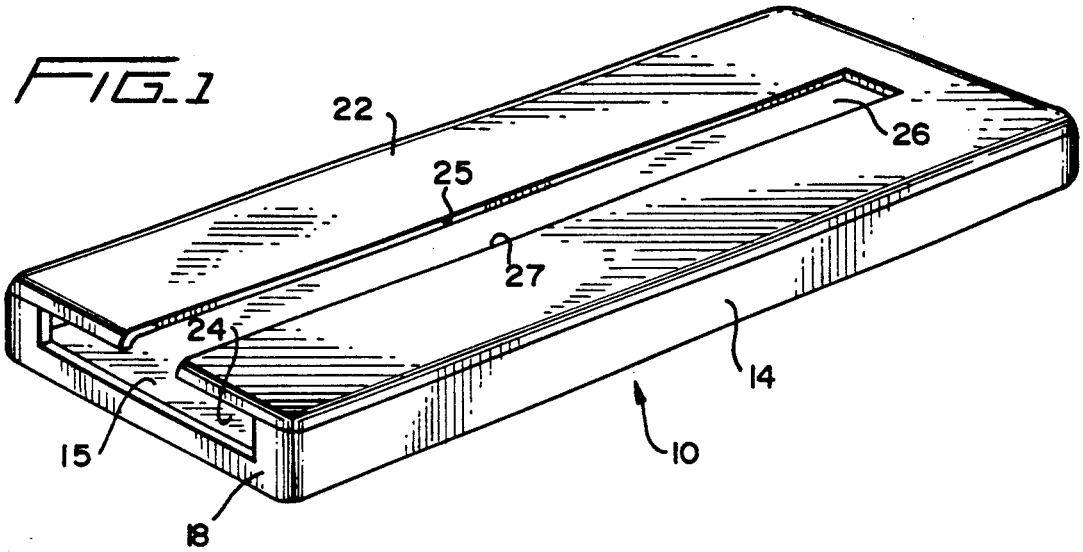
FIG. 2
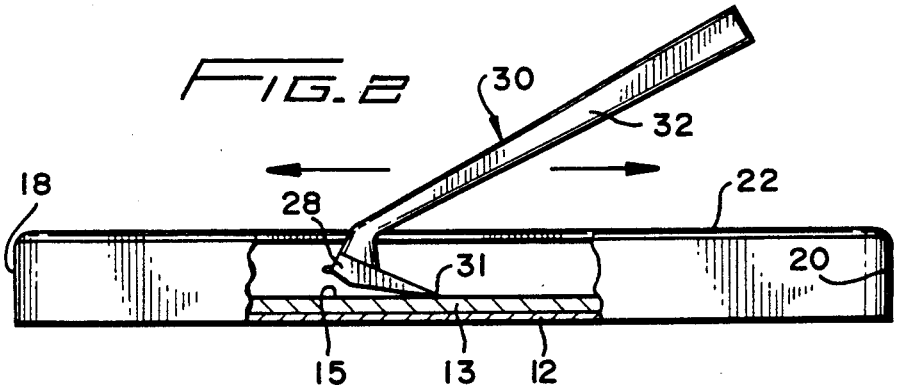
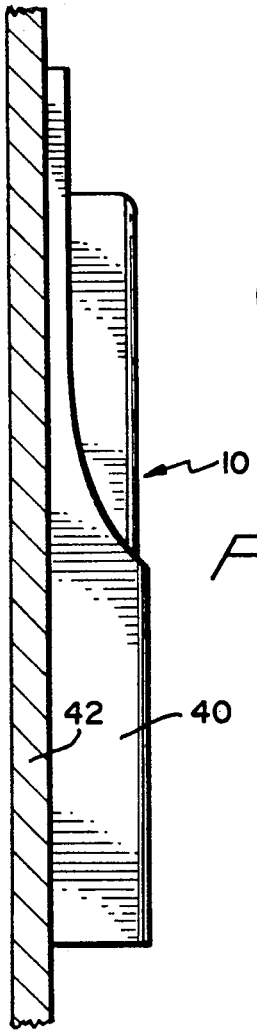
FIG. 4
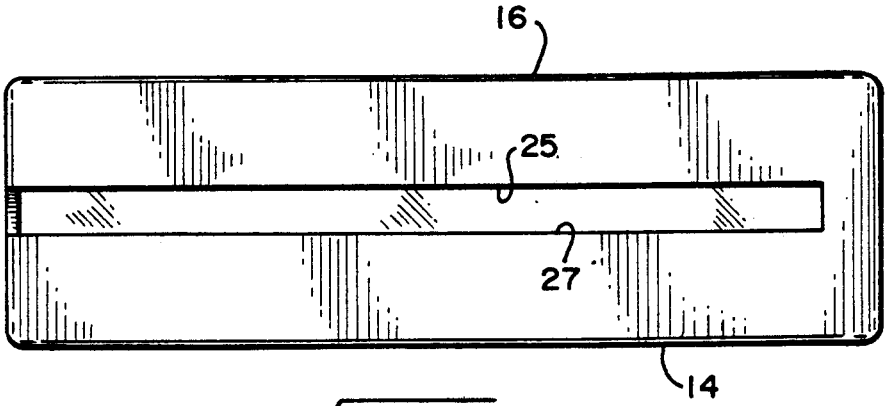
FIG. 3

RAZOR SHARPENING DEVICE

FIELD OF THE INVENTION

The present invention relates in general to apparatus for sharpening razor blades and relates more particularly to apparatus for sharpening razor blades used for shaving the face and legs of the body.

BACKGROUND OF THE INVENTION

Safety razors typically used for shaving the face and other hairy regions of the human body consist of a metal and/or plastic handle attached to a razor head for holding a razor blade. Generally the razor blades are capable of not more than 5 to 10 close shaves before the cutting edge portion becomes so dull that the user must either change blades or, in the case of the disposable razor, must discard the dull razor of a new one. There is a need for a quick and simple means for re-sharpening the blades in order to extend their useful life.

SUMMARY OF THE INVENTION

It is accordingly one object of this invention to provide an apparatus for sharpening the cutting edge of a razor blade used in a razor. Other objects of this invention are to provide apparatus which can rapidly sharpen a razor blade which has no moving parts, which is compact and which is durable.

In accordance with the present invention, there is provided apparatus for sharpening the cutting edge of a razor blade which is mounted within a razor head having a handle attached thereto. The apparatus comprises a housing which holds a sharpening element and which is adapted to accommodate a razor. The housing includes an elongated, substantially flat bottom member, side walls attached lengthwise along the opposite edges of the bottom member to form a channel for linear movement of the razor head therein. A top plate which is secured to the upper edges of the side walls is provided with a longitudinally-extending slot for movement therein of the razor handle. An access opening for the razor head is provided in the housing, and a substantially flat sharpening element is secured to the upper surface of the bottom member.

In one embodiment of the invention, a wall unit is provided to store the sharpening apparatus when not in use.

BRIEF DESCRIPTION OF THE DRAWINGS

The invention is further described in the detailed description below taken in conjunction with the accompanying drawings in which :

FIG. 1 is a view in perspective of the razor sharpening apparatus;

FIG. 2 is an elevated view in fragmentary cross-section of the present apparatus showing a safety razor in the sharpening position during the sharpening process;

FIG. 3 is a top view of the razor sharpener apparatus shown in FIG. 1; and FIG. 4 shows a razor blade sharpener of the present invention as it is stored in a wall mounting case.

DETAILED DESCRIPTION OF THE INVENTION

Referring now to the Figures, the housing 10 comprises a bottom wall 12, side walls 14 and 16, end walls 18, 20 and top plate 22. A sharpening element 13 which has a substantially planar sharpening surface 15 is secured to bottom wall 12.

A longitudinally-extending slot 26, defined by parallel walls 25, 27 in top plate 22, is provided for accommodating the handle 32 of a razor 30. End wall 18 is provided with a transverse slot 24 for providing access with the housing for razor head 28. Alternatively, access to the interior of the housing for the razor head may be achieved by providing a slot in top plate 22 at right angles to slot 26.

Sharpening element 13 may be made from a variety of hard materials, such as a metal, and is preferably made from a hard vitreous material such as, for example, glass, porcelain or a ceramic. These vitreous materials have the advantage that they are inexpensive, are readily available, and are hard enough to serve as sharpening elements. The surface 15 may be an abrading surface such as an etched or sand blasted surface, but is preferably a smooth flat glass surface, such as can be achieved by conventional glass production methods and as exemplified by the face of a glass mirror.

The material from which housing 10 is made is not critical and it may suitably be made from a material such as steel or aluminum, or it may be made from a plastic.

A razor blade may be resharpened by inserting the razor head 28 within housing 10, holding handle 32 so that cutting edge 31 is parallel to sharpening surface 15, and moving the razor 30 back and forth through the length of slot 26. Cutting edges 31 is honed as it is moved back and forth through slot 26 while it is pressed against sharpening surface 15.

Referring now to FIG. 4, a wall mounted case 40 provides a simple means for mounting razor sharpener 10 on a bathroom wall 42 when not in use. Adhesive pads (not shown) may be used to attach wall mount holder 40 to wall 42.

The embodiment described herein is for the purpose of illustrating the present invention, and workers skilled in the art will recognize variations thereof that fall within the scope of this invention, which is limited only by the claims appended thereto, and equivalents of the features described therein.

What is claimed is:

1. Apparatus for sharpening the cutting edge of a razor blade which is secured within a holder, said holder having a razor head for retaining said blade in a cutting position and a handle mounted on said head, said apparatus comprising a housing and a sharpening member mounted within said housing, said housing comprising:

an elongated, substantially flat bottom member, said bottom member having an upper surface and side edges;

side walls attached lengthwise along said opposite edges of said bottom member and forming a channel for longitudinal movement therein of said razor head, said side walls having upper edges;

a top plate secured to said upper edges of said walls and having a slot therein extending lengthwise of said top plate and parallel to said sidewalls for engaging said handle to guide said razor head for movement along said channel; and, an access opening extending substantially perpendicular to said slot for inserting said razor head into said channel;

said sharpening member being mounted on said upper surface of the bottom member of said housing and having a sharpening surface positioned to be engaged by the cutting edge of said razor blade during said movement of said razor head along said channel.

2. Apparatus according to claim 1 wherein said housing includes at least one end wall and said access opening is provided in said end wall.

3. Apparatus according to claim 1, wherein the material for said sharpening member is glass, porcelain, or ceramic material.

4. Apparatus according to claim 1, wherein said sharpening surface comprises a smooth flat glass surface.

5. Apparatus according to claim 4, wherein said smooth flat surface is the glass surface of a mirror.

6. Apparatus according to claim 1, wherein said sharpening surface comprises an abrasive surface for engaging said blade.

7. Apparatus according to claim 6, wherein said abrasive surface is an etched surface.

8. Apparatus according to claim 6, wherein said abrasive surface is a sandblasted surface.

9. Apparatus according to claim 1, further comprising a case adapted for storing said holder and means for mounting said case on a wall.

* * * * *